US006062976A

United States Patent [19]

De Guzman

[11] Patent Number: 6,062,976

[45] Date of Patent: May 16, 2000

[54] AIR SHOWER ASSEMBLY AND GOWN INFLATION APPARATUS

[75] Inventor: Joselito De Guzman, Redondo Beach, Calif.

[73] Assignee: Micronova Manufacturing, Inc., Torrance, Calif.

[21] Appl. No.: 09/175,921

[22] Filed: Oct. 20, 1998

Related U.S. Application Data

[63] Continuation-in-part of application No. 08/756,137, Nov. 27, 1996, abandoned.

[51] Int. Cl.[7] ..... B08B 5/02

[52] U.S. Cl. ..... 454/187; 15/301; 454/370

[58] Field of Search ..... 15/300.1, 301, 15/302, 345, 346; 312/1; 454/187, 370

[56] References Cited

U.S. PATENT DOCUMENTS

| | | | |
|---|---|---|---|
| 3,483,572 | 12/1969 | Hallum | 15/302 |
| 3,629,999 | 12/1971 | Marsh | 454/187 |
| 3,728,866 | 4/1973 | Layton | 454/187 |
| 3,875,927 | 4/1975 | Trexler . | |
| 4,304,224 | 12/1981 | Fortney | 454/187 |
| 5,558,112 | 9/1996 | Strieter | 15/301 |

*Primary Examiner*—Terrence R. Till
*Attorney, Agent, or Firm*—Henricks, Slavin & Holmes LLP

[57] ABSTRACT

An improved apparatus and method are disclosed for reducing or minimizing the particulates and other contaminants which may be brought into a restricted or clean room area. The apparatus and methods include an improved gown having positioning elements for keeping portions of the gown in place to permit inflation of the gown, for example during an airwash, and the apparatus and methods may also include gown inflation apparatus to remove the particulates and contaminants. Apparatus and methods of the present inventions also inflate the gown not only to eject particulates and contaminants that may be entrained or caught in the gown fabric, but also can be used to inflate the gown while the operator is in an air shower. Methods and apparatus of the present inventions also provide for an improved glove to gown seal, in addition to a reduced possibility of contamination from particulates or moisture from the operator's hands and an enhanced comfort level in the use of latex or rubber gloves with the gown. These and other features and benefits of the inventions disclosed herein will be more fully understood upon consideration of the following descriptions.

20 Claims, 5 Drawing Sheets

FIG. 4.
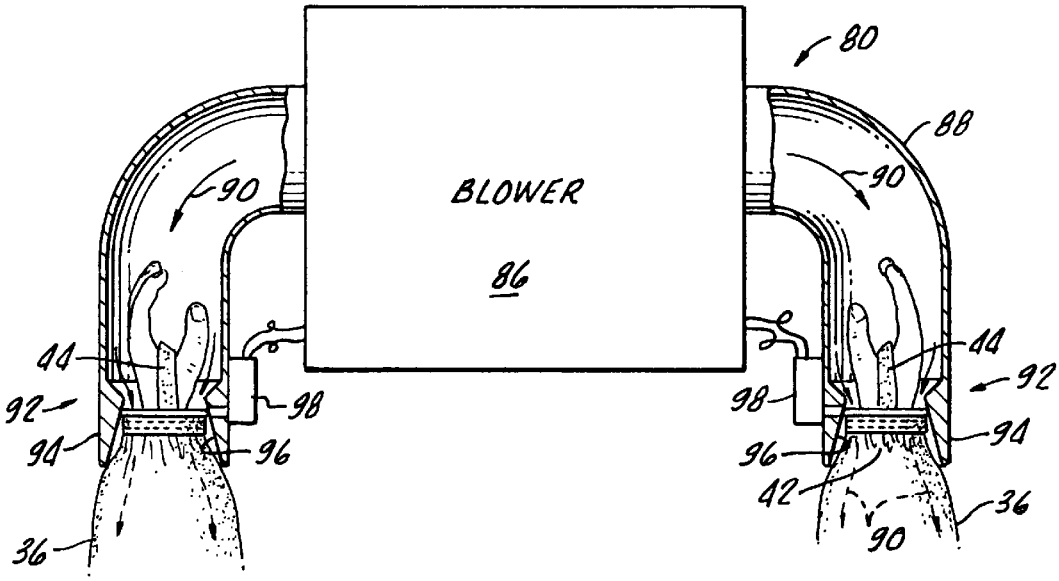
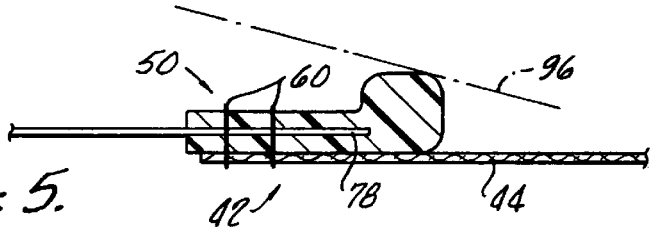
FIG. 5.
FIG. 7.
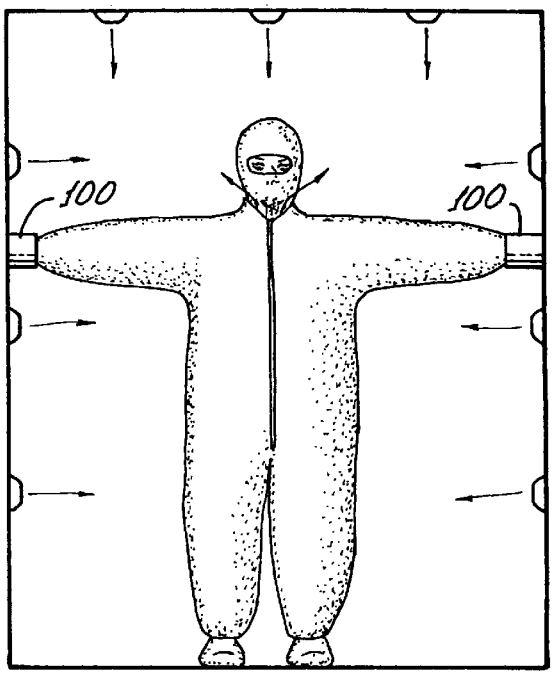
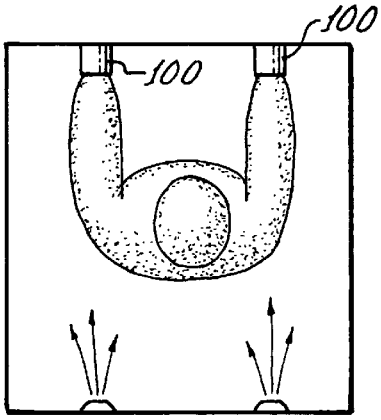
FIG. 6.

AIR SHOWER ASSEMBLY AND GOWN INFLATION APPARATUS

CROSS-REFERENCE TO RELATED APPLICATIONS

This application is a continuation-in-part of application. Ser. No. 08/756,137 entitled "GOWN ASSEMBLY, GOWN CUFF ASSEMBLY, AND GOWN AND AIR SHOWER ASSEMBLY" filed on Nov. 27, 1996, now abandoned both of which are owned by Micronova Manufacturing Inc. of Torrance, Calif.

BACKGROUND OF THE INVENTION

1. Field of the Invention

The present disclosure relates to sleeves, gown assemblies, such as those used in clean rooms, hospitals, and the like, gown and cuff assemblies, and gown and air shower assemblies.

2. Description of the Related Art

Clean rooms and other sensitive environments have very strict requirements for operation intended to minimize contamination, either of product within the environment, or contamination of personnel or articles which, at some point, would exit the restricted environment. For clean rooms, procedures and restrictions attempt to minimize the possibility of contamination of product being made in the clean room caused by particulates or charged particles brought into the clean room from the outside. In medical applications, such as surgery suites, procedures and restrictions seek to minimize the possibility of infection or other contamination of a patient by organisms brought in from the outside by operating room personnel. In research facilities, as another example, restrictions and procedures are in place to minimize the possibility organisms or contaminants escape the facility either carried by personnel or on garments or equipment used within the facility. In many such situations, personnel are required to wear protective clothing including gowns, headwear, footwear, gloves and often masks. This apparel serves to minimize the undesirable contamination or exposure.

For illustrative purposes only, the following discussion will be directed primarily to clean room environments, such as those for manufacturing semiconductor devices. Clean rooms are generally well controlled environments made up of sealed or otherwise contained rooms with positive pressure ventilation and environmental regulation often producing no more than one hundred parts per million of environmental particulates. Personnel working in clean room environments typically are required to wear full body gowns, headwear, footwear and gloves, such as latex or rubber gloves such as those worn for surgery and medical examinations. Face masks are also typically required, or the full body gowns may include a face cover. Partial gowns such as labcoats may also be used, such as with a laminar flow hood, in which case only a partial body covering is used. Partial gowns might include only a torso cover with sleeves and a neck and possibly a head cover. Gloves would typically be worn with a partial gown as well.

After putting on this apparel, personnel may enter an air shower to eliminate as much as possible any airborne contaminants or contaminants carried on the person's clothing or protective apparel. The air shower is a positive pressure ventilated room including a number of higher pressure air jets directing forced air streams at the center of the room where the person would be standing. The air jets are intended to push off any particulates from the garments or apparel, after which the airborne particulates are removed from the air shower by the ventilation system. While the air shower is capable of removing some particulates in this manner, not all particulates which may eventually become airborne and contaminate a work piece in the clean room can be removed in the air shower. For example, the air streams from the pressurized air supply sometimes force particulates into the fabric of the garment rather than sweeping it off the garment. Additionally, folds created in the garment after the garment has been put on often retain particulates which are difficult to remove through an air shower. Low velocities are effective, if at all, in removing only large particles from the gown. High velocity air showers are more effective in removing both large and small particles, but some small particles can actually be driven into the fabric weave. The embedded particles may later become disengaged from the garment inside the clean room.

Within the clean room area, there may be certain areas where personnel are required to exercise extra care to eliminate as much as possible the contamination of an area or of a work piece. For example, extra care is taken near a wet bench area, where sensitive or critical processes of the work pieces are handled. In this area, a positive air pressure is typically provided to further remove particulates from the wet bench area, thus creating a region within the clean room that preferably has a lower particle count. However, personnel moving between the wet bench area and other areas in the clean room may carry particulates embedded in their gowns to the wet bench area, consequently increasing the likelihood of contaminating the work piece they are working on.

The sleeves are of particular importance because the sleeves are the garment areas closest to and most likely come into contact with any work pieces as the personnel work in between the wet bench area and the rest of the clean room. Thus, personnel may change into another gown and go through another air shower before working near the wet bench, which is inconvenient and adds time and money to the manufacturing process.

Current gowns use breathable fabrics or non-breathable fabrics or materials. Non-breathable materials include TYVEK, vinyl and other common materials. Breathable fabrics include Goretex and polyester and polyester blend fabrics and other woven or non-woven materials. The breathable materials or fabrics allow moisture to escape from the operator through the fabric for comfort, and particles larger than 0.3 microns are also filtered or blocked, and not allowed to escape from the gown. Seams and joints are folded and double stitched to prevent holes from which particles can escape.

With such gowns, one source of highest probability of contamination is the sleeve and hand area for the garment and operator. Where rubber or latex gloves are used by the operator, the glove cuff is typically placed over the end of the sleeve, and is held in place by the elasticity of the cuff on the glove. However, cuff roll down often occurs, and the seal between the glove and the wrist area of the garment may be jeopardized. Some glove designs have extra long cuffs or integral elastic bands around the cuff to enhance sealing. These gloves are relatively uncomfortable, and cause buildup of heat and perspiration inside the glove and along the cuff. Airflow is restricted and moisture is trapped within the glove and in the wrist area.

The integrity of the hand and wrist area of the operator is of utmost importance since it is that area which is closest to and most likely comes into contact with any work pieces that the operator is handling. Therefore, extra measures are warranted to ensure that any contamination from the hands and wrist areas of the operator and the operator's garments are minimized. Since humans are a major source of contamination in clean room environments, some extra measures should be directed to minimizing contamination from human sources. Gown design is very important to reduce contamination from the body through the gown, but 100% particle containment would require a gown that was uncomfortable to wear and one which would most likely is preclude efficient and effective work. The present source of highest contamination from the body and from the gown is the glove and gown interface. No adequate seal is presently achieved with current techniques.

Longer glove cuff lengths add cost to the glove and promote allergic reaction due to inadequate ventilation. Inadequate ventilation, heat and moisture buildup results especially around the palm of the operator's hand and between the fingers. Any allergic reaction is accentuated for those who react to latex or wearing rubber gloves because of the inadequate ventilation. Longer cuff lengths, nonetheless, are not completely secure.

Glove seals formed by an elastic band used in conjunction with the glove cuff increases the cost of the glove, requires an extra operation and also is not completely secure.

Tape seals used to seal the glove around the sleeve cuff secures twisted or folded portions of the cuff and removes slack from the cuff, but requires an extra operation, and is itself not completely secure. The glove can still slide off of or move relative to the sleeve cuff, such as when the sleeves are pulled during normal arm movement or otherwise. In such circumstances, any seal between the glove and the sleeve cuff may be broken or changed. Additionally, taping the sleeve cuff and the glove cuff together is suitable only for disposable gowns, since the tape typically leaves a residue on the garment, which is undesirable for reusable garments.

There exists, therefore, a need for an improved apparatus and method for removing possible particulates and other contaminants from operator's gowns, as well as an improved apparatus and method for using the gowns and for creating an improved glove to gown seal.

SUMMARY OF THE INVENTION

The present disclosure is directed to a new apparatus and method for minimizing creation or release of contaminants from clean room operators and operators in other restricted environments, a method and apparatus for removing possible contaminants from an operator's gown, as well as apparatus and method for improving the seal between an operator's garment and gloves. The disclosure also describes an apparatus and method which improves the operator comfort and use of a garment, including a gown, and glove combination. In one aspect of the inventions, the improved apparatus and method increase the removal of loose particles on garments, such as gowns, as well as increases the removal of interstitial particles from the gown fabric. Additionally, particle and other contaminant removal from the garments worn by the technician, in the method and apparatus of one aspect of the present inventions, places particular emphasis on removal from the wrist and sleeve area, over the neck and feet openings. Other aspects of the present inventions also improve the sleeve cuff configuration to promote evaporation and removal of moisture from extremities such as the hands, improved glove cuff-to-sleeve cuff seal, and promote an airtight seal between the glove and the sleeve.

An improved gown for covering at least a part of a person's torso includes a body and a sleeve wherein the sleeve includes a positioning element for ensuring that the end of the sleeve remains positioned substantially in the desired location relative to the arm. With the sleeve properly positioned, the sleeve can then be used as an inlet for pressurized air or other fluid for inflating the gown. Gown inflation accomplishes a number of functions. The inflated gown minimizes or entirely removes any folds or wrinkles which could retain or trap particles. Gown inflation exposes those particles to removal by the air shower. Gown inflation also provides a positive pressure differential between the inside surface of the gown and the outside, thereby improving the rate of removal of particulates entrained or embedded in the fabric of the gown. Gown inflation at the sleeve also improves removal of particulates which may be concentrated in the area of the sleeve by forcing the particulates away from the sleeve and toward the neck and feet or other openings in the gown. Removing the particulates and other possible contaminates from the sleeve area minimizes the possibility that contaminates may be transmitted to a work piece by the operator's hands or arms. Once the gown is no longer inflated, deflation or relaxation provides a better fit of the gown around the operator.

Where the gown is used in conjunction with latex or rubber gloves, or other hand coverings which promote generation of perspiration, the positioning element can assist in reducing the level of moisture or perspiration buildup. The positioning element, such as where it is a strip or length of fabric, serves to break any seal that may have formed between the user's skin and the glove material. Breaking the seal allows air flow from inside the glove up the sleeve, thereby removing moisture that may have built up inside the glove. Hand movement when the glove is on the hand creates a pumping action ejecting moisture-laden air and drawing in air from the sleeve. Where the gown fabric is breathable, as with many gowns, the air in the sleeve would have a lower moisture content than the air within the glove.

In one preferred form of the inventions, the positioning element may take the form of a loop attached to the sleeve, for example, in a manner to allow the loop to rest in the cradle between the operator's thumb and index finger. Thus, when the gown is to be inflated through the sleeve, the pressure of the air along the sleeve does not move the sleeve up the arm appreciably. In a preferred embodiment, both sleeves have loops and the gown would be inflated through both sleeves.

In a further preferred form of the inventions, the positioning element or loop may be formed from elastic or other fabric material which would contribute to the wicking away, or removal by capillary action, of any moisture or perspiration which is generated within the glove during normal use. For example, where a loop rests in the joint between the thumb and index finger, the loop would wick away moisture from the fingers and palm of the hand with each contact between the loop and the operator's skin. Alternatively, additional straps can be placed between each finger or in other arrangements to promote wicking.

In another form of the inventions, a garment such as a sleeve or partial sleeve includes structure at or near the end of the sleeve for keeping at least part of the cuff open during normal use, even when a cuff of a latex or rubber glove is placed over the sleeve cuff. Leaving at least part of the sleeve cuff open around the user's arm or wrist, promotes removal or evaporation of moisture from the user's hand, thereby promoting comfort and reducing strain in the hand or arm. Such a sleeve cuff configuration may also be helpful in forming a seal between the sleeve and a glove placed over the sleeve cuff.

In another form of the invention, the sleeve is on a gown and includes structure at or near the end of the sleeve which also keeps at least part of the cuff open during normal use, even when a cuff of a latex or rubber glove is placed over the sleeve cuff. In one preferred embodiment of the sleeve described above or the gown with a sleeve, the sleeve cuff includes a flexible and resilient element, but one which is not as pliable as the sleeve fabric or other cloth, and is preferably a flexible plastic or other element which is more resilient than the fabric. Preferably, the resilient element is formed as a loop, or closed and circular element, completely encircling the wrist portion of the operator when the gown is on. A resilient plastic, flexible loop or ring keeps the sleeve cuff open for passage of air from the hand up the sleeve. It may also provide a relatively rigid support, compared to the fabric by itself, over which the glove cuff may be placed to provide an air and moisture tight seal between the glove cuff and the sleeve cuff. A ring or other similar element also would reduce the restriction of the sleeve cuff around the operator's arm caused by the latex or plastic glove cuff. The cuff ring inhibits glove cuff roll down, and allows any loop or other element to wick away moisture from the palm and other parts of the hand.

In one preferred form of the sleeve cuff ring, the ring is formed from concentric rings sandwiching the sleeve cuff fabric between them. The concentric rings may be ultrasonically welded to hold the fabric in place. Alternatively, the fabric or other gown material may be bonded or otherwise attached to the ring so that the sleeve is at least longitudinally fixed to the sleeve cuff ring, even though it may still slip about the circumference of the ring. In another embodiment, the sleeve cuff fabric is sewn around the ring or hoop. The ring causes the sides of the cuff to be outwardly positioned relative to the operator's arm or wrist. In such a configuration, sufficient space would be available for air flow up the sleeve cuff even if one side of the sleeve cuff were to rest against the user's wrist. Preferably, the diameter of the ring is substantially the same as the sleeve cuff diameter so that there are few if any gathers in the sleeve material and so that the sleeve material is not stretched too much. Additionally, where the sleeve cuff includes a positioning element such as the loop, the loop engages the ring so that the sleeve cuff is reliably positioned along the selected portion of the operator's arm or wrist.

Another aspect of the present invention is a sleeve only without the gown. The sleeve may have all the characteristics of the sleeve forming part of a full body gown described above, but the sleeve preferably has an elastic open end opposite the sleeve cuff that is positionable around a user's arm. At or near the other end, however, the sleeve preferably has all the features of the sleeves described in the gown. For example, the cuff may include a structure for keeping the cuff open during normal use, such as a flexible and resilient element, or a ring that inhibits the glove cuff roll down, and/or a positioning element or loop that is coupled to the sleeve.

A sleeve having the characteristics described above reduces the likelihood of contaminating the work piece. Additionally, operators who have to exercise extra care around the wet bench area can easily put on a new sleeve before entering this area instead of having to put on a new gown and go though another air shower, which saves time and money. Also, a full gown may not be necessary at all times, in which case a sleeve alone without the full gown may suffice during a less sensitive or less critical operation, thus saving time and money again.

In accordance with another aspect of the present invention, an apparatus and method is provided for inflating a gown to better remove particulate and potential contaminants. The apparatus and method includes a pump for pumping a fluid and an adapter for inflating the gown with fluid from the pump. Preferably, the gown is inflated while the operator is within an air shower so that inflation of the gown can facilitate washing away of any particulate and potential contaminants from the gown and the operator.

In a preferred embodiment, the apparatus includes an adapter on the pump assembly for receiving the hands of an operator. The gown preferably includes hoops or rings in the sleeve cuffs of the gown to form seals within the adapters of the pump assembly so that substantially all of the fluid is directed inside the sleeves rather than around the outsides of the sleeves. Also in accordance with the preferred form of the invention, the pump is automatically activated when the operator's hands or the sleeve cuff rings are positioned at a predetermined position in the adapter.

Also in a preferred form of the invention, the inflation apparatus is configured so as to accommodate different heights and arm lengths for operators, and permits arm movements by the operators while in use. A preferred configuration has the gown being inflated when the operator's arms are horizontal and extending in opposite directions, thereby minimizing the creation or existence of creases in the gown.

The present inventions improve the control of contaminants and the procedures used in reducing the number of contaminants which are brought into controlled areas. These and other aspects of the present inventions are discussed and disclosed more fully below in conjunction with the drawings and the detailed description.

BRIEF DESCRIPTION OF THE DRAWINGS

FIG. 4 is a top plan and partial cut-away view of a gown inflation apparatus for use with the gown of FIG. 1 in accordance with a further aspect of the present inventions.

FIG. 5 is a detailed cross sectional view of a sleeve portion and sleeve cuff and a positioning element relative to an imaginary plane representing a portion of the inflation apparatus.

FIG. 6 is a top plan view of a contamination control room/air shower similar to that shown in FIG. 2.

FIG. 7 is a front elevation and partial cross sectional view of a contamination control room in accordance with a further aspect of the present inventions.

DETAILED DESCRIPTION OF THE PREFERRED EMBODIMENTS

An improved apparatus and method are disclosed for reducing or minimizing the particulate and other contaminants which may be brought into a restricted or clean room area. One aspect of the apparatus and methods include an improved sleeve or gown having positioning elements for keeping portions of the sleeve in place to permit inflation of the gown, for example during an airwash, and the apparatus and methods may also include gown inflation apparatus to remove the particulates and contaminates. Apparatus and methods of the present inventions also inflate the gown not only to eject particulates and contaminates that may be entrained or caught in the gown fabric, but also can be used to inflate the gown while the operator is in an air shower. Methods and apparatus of the present inventions also provide for an improved glove to sleeve seal, in addition to a reduced possibility of contamination from particulates or moisture from the operator's hands and an enhanced comfort level in the use of latex or rubber gloves with sleeves or a gown. These and other features and benefits of the inventions disclosed herein will be more fully understood upon consideration of the following descriptions.

Figure 1:
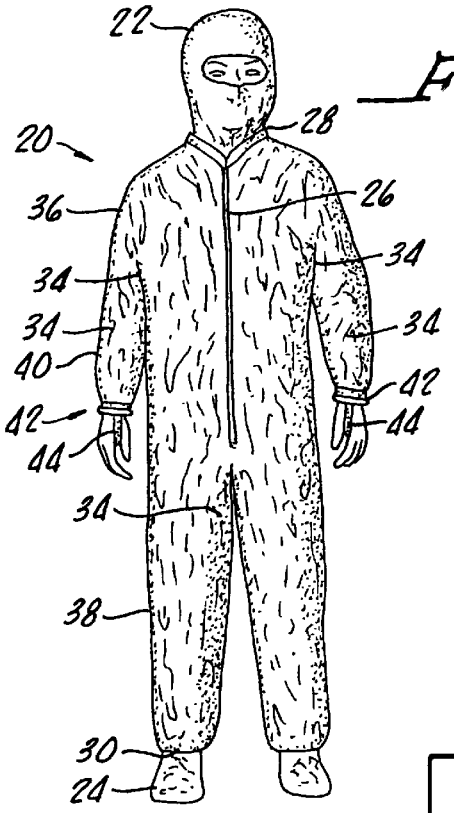
FIG. 1 is a front elevation view of a gown in accordance with one aspect of the present inventions being worn by an operator along with headgear and footwear.

Clean rooms and other regulated environments often require operators to wear gowns or other garment covers, such as gown 20 (FIG. 1) for minimizing the escape of contaminants and particulates from the operator's body and underclothing. Such contaminants may include, for example, lint particles, skin particles, hair particles, moisture particles, and the like. Such particles may be produced during normal movement within a clean room, during close work over a work piece (not shown) or under many other circumstances encountered during normal clean room operations. The gown 20 minimizes the possibility of such particulates being introduced into the environment of the clean room, with the attendant possibility that the particulate may contaminate work surfaces or products being worked on at the time or later.

Typically, gowns are whole body suits with elastic gathers at the cuffs, and the operator will also typically wear a head cover 22 as well as foot covers 24. The gown is closed by a front zipper 26 up to a neck portion 28 within which the lower portions of the head cover 22 are inserted. The leg cuffs 30 may be inserted within or disposed over the outside of the foot covers 24.

After donning the gown, along with the head cover and foot covers, the operator will be ready to enter an air shower 32 (FIG. 2) either before or after donning gloves. Because of the oversized fit of the gown, the gown fabric will typically hang on the operator with folds or creases 34. These folds and creases may trap particulates, and particulates or other contaminants may also be resting on the surface of the gown or other coverings. Particulates may also be imbedded in or trapped within the interstices of the gown fabric.

In a preferred version of the gown, the gown includes a body 36 for substantially encircling at least the person's torso, and preferably includes leg portions 38 encircling each leg and sleeve portions 40 encircling each arm. The sleeve portions are integral with or attached at a first end to the body of the gown and have second sleeve end portions 42 defined by the end of the sleeve opposite the first end. Each sleeve preferably includes a positioning element 44 at each second end of the sleeve portion for positioning each respective sleeve end at a desired position relative to the operator's arm. Preferably, the second sleeve end portion or sleeve cuff 42 is positioned around or near the wrist portion of each arm. The gown material is preferably formed of non-stretchable material, for example so that the fabric pores or openings do not change significantly in size, and so that the positioning elements, described more fully below, more directly function to position the sleeves as desired.

Each positioning element 44 may be formed as a loop fastened at appropriate locations on the sleeve cuff 42 to be comfortable and to provide the appropriate positioning of the sleeve cuff. The positioning element is preferably formed from elastic or other biasing material for ensuring proper positioning of the sleeve cuff.

When the gown is donned, the positioning element or loop 44 is preferably placed between the thumb 46 and forefinger or index finger 48. Preferably, the loop 44 on the palm side will be positioned on the sleeve cuff 42 approximately at the base of the thumb so that the loop rests comfortably in the palm of the hand. The back hand side of the loop 44 is preferably positioned at an approximate midpoint on the sleeve cuff so that the back hand portion of the loop is approximately centered on the back of the hand, so that the two ends are approximately 180 degrees apart on the sleeve cuff. In the preferred embodiment, the loop is sewn around or sewn to, or otherwise fastened, fixed, adhered or bonded to, the sleeve cuff.

The loop 44 serves a number of significant functions. The loop serves to consistently maintain the position of the sleeve cuff 42 around the wrist, regardless of arm movements and stretching, which might be required during normal activities in a clean room. The loop also maintains the position of the cuff as the gown is being inflated for decontamination or washing. Additionally, where the loop 44 is formed from a fabric or other material which can have a capillary action or wicking action, the loop will serve to wick away moisture from the palm of the hand and other areas on the hand which may be contacted by the loop. As is well known, perspiration is common on the palms and the hand while the hands are covered by latex or rubber gloves. Normal body temperature and hand movements generate heat and the latex or rubber glove results in the hand producing perspiration to eliminate the heat generated in the hand. The loop also serves to break any glove-to-skin seal that may have formed during normal use of the glove, especially where moisture from the hand forms a film sealing between the skin and the glove material.

Other structures or configurations may also serve a wicking function. For example, any fabric or porous or semi-porous material placed along the palm or along the back of the hand may wick moisture away from the hand toward the wrist, and also other materials may help to break any seal that forms between the skin the glove material. A strip of material having a thumb hole may also serve the same function when placed along the palm of the hand and extending backward toward the wrist. However, in the preferred embodiment, the loop 44 serves a double function of maintaining the sleeve cuff in position as well as wicking moisture away from the palm.

The sleeve cuff 42 preferably includes material for keeping at least part of the cuff open during normal use, as opposed to collapsed or pressed against the operator's wrist. In the preferred embodiment, the material is formed from a flexible element such as a plastic ring, hoop, circular, continuous annulus or the like. Preferably, the ring is formed from high density polyethylene and is resilient and thick enough to maintain sufficient structural rigidity under normal operation to flex and return to its original form when relaxed, but is thin enough to be sewn in order to attach the gown fabric to the ring and, if desired, the loop 44 to the cuff. The HDPE material could be about 0.030 inch in thickness and the length in the longitudinal direction may be less than an inch to as much as three inches or more. Thin HDPE is relatively low cost and well suited for disposable garments, such as gowns typically used in clean rooms. One preferred material is a boning material called Rigilene marketed by Selectus. It has flexiblity, resiliency and rigidity sufficient to serve the desired functions, and also has a ridged or non-uniform surface that a glove can rest over to further inhibit cuff roll down. The gown fabric and any other material added about the ring would also add strength to the sleeve cuff.

Nytrile may also be used, especially in chemically active environments. Nytrile is chemically resistant, and bendable and stretchable. The ring can be used on any appendage having a covering such as a gown sleeve or the like such as a the arm or leg. However, the sleeve is preferred because of the preference of removing particulates from the location of the body which would most likely contact the work piece.

Figure 8:
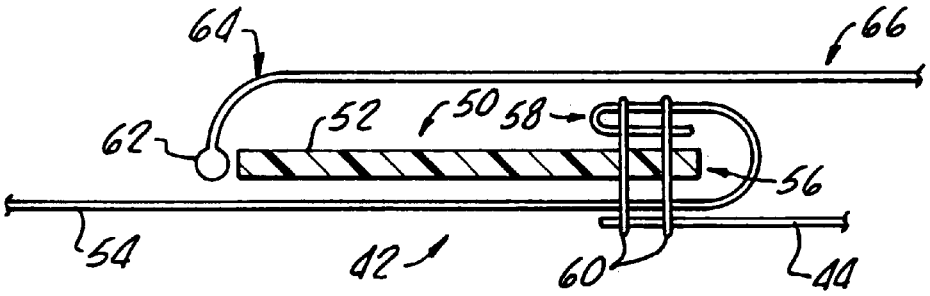
FIG. 8 is a partial cross sectional view of a portion of the sleeve cuff, positioning element, and a portion of a glove in accordance with a further aspect of the present inventions.

As shown in more detail in FIGS. 5 and 8, the ring 50 can take many configurations, and is preferably plastic. The simplest configuration, shown in FIG. 8, is a circular ring having a rectangular cross section, as shown at 52 in FIG. 8. The ring would extend in a closed circle around the outside of the gown fabric 54, in the preferred embodiment, to provide structure and support for the cuff 42. The cuff preferably includes sides defining the opening in second end of the sleeve, wherein the ring biases the cuff open. In other words, the ring causes the sides of the cuff to be outwardly positioned relative to the remaining portions of the sides of the cuff. The ring is preferably rigid enough to expand the cuff in a direction the same as the direction of any force or impact applied to the cuff. For example, if a finger were pressed against the sleeve cuff containing the ring, pressing the sleeve cuff against the arm, the opposite side of the sleeve cuff would form a larger opening between the arm and the sleeve cuff, thereby allowing substantially the same amount of air up the sleeve and also allowing moist air from the hand to pass up the sleeve. However, it should be understood that the material for keeping at least part of the cuff open could be less than a complete, closed ring.

In the preferred embodiment, the gown fabric 54 extends forwardly of the ring 52 and is folded outwardly and over the front portion 56 of the ring 52. The end of the gown fabric on the sleeve is doubled back on itself at 58 and attached, fastened, bonded, adhered or otherwise fixed to the forward portion 56 of the ring 52, such as by threads 60. The threads 60 may also fasten the loop 44 to the sleeve cuff at the desired locations.

Figure 9:
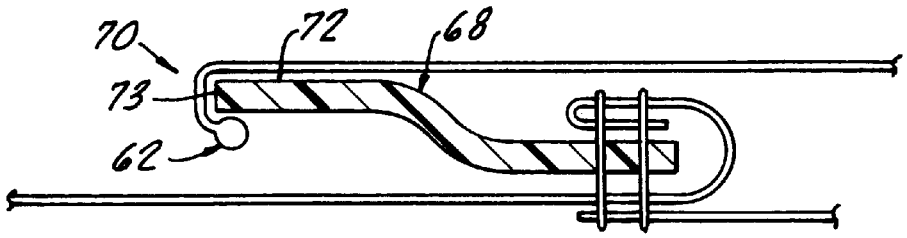
FIG. 9 is a partial longitudinal cross sectional view of a cuff ring alternative to that shown in FIG. 8 in accordance with a further aspect of the present inventions.
Figure 10:
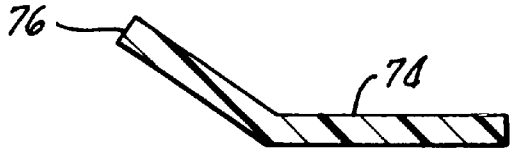
FIG. 10 is a partial longitudinal cross sectional view of a cuff ring in accordance with a further aspect of the present inventions.

The ring 52 preferably extends rearwardly from the end of the cuff 42 a distance sufficient to provide structural integrity to the cuff and to allow space for a ledge or resting point for the bead 62 on the cuff 64 of a glove 66. The configurations of the ring shown in FIGS. 9 and 10 are believed to enhance the retention of the bead 62 of the glove over the ring. For example, the ring 68 in FIG. 9 provides a lip 70 over which the bead 62 of the glove will extend and be retained. The substantially straight portion 72 of the ring 68 will provide a sealing surface between the glove and the ring to minimize any loss of moisture or particulates from inside the glove or the gown to the outside. Additionally, the reduced diameter, distal portion allows some clearance to accommodate the sleeve fabric underneath the glove material. In doing so, the glove material would still form a seal with the proximal-most portion of the ring, which would not be covered by any sleeve fabric. In other words, the sleeve fabric would extend rearwardly or proximally over the outside of the ring less than half of the longitudinal distance of the ring.

In the embodiment shown in FIG. 9, the glove would also form a relatively good seal against the proximally-facing surface 73, especially with beaded gloves. The bead of beaded gloves would curl around and extend inwardly relative to the ring 68. The glove material immediately adjacent the bead then contacts the entire flat surface 73 and forms a seal along with the seal formed along the surface 72, thereby enhancing the glove cuff to sleeve cuff seal.

A further benefit of the embodiments of FIGS. 8–10 derives from using gloves having beaded cuffs. As shown in FIG. 9, the glove bead 62 typically will be curled inwardly relative to the outer surface of the glove. The inward curl and the adjacent glove cuff material will tend to bear against the ring surface 73, and if the glove were to be pulled in a direction away from the ring, the bead would eventually come to rest against the ring end adjacent ring surface 73. Resting against the ring end, the glove bead would inhibit further glove removal, with normal hand movement. Thus, an inwardly-curling bead embraces the seal between the glove and the ring.

The ring 74 shown in FIG. 10 would also allow the bead of the glove to extend over the lip 76 and be held in place by the ring 74.

The diameter of the ring is preferably sufficiently large to enable all hand sizes to fit through the ring, even if the ring must be flattened somewhat to allow the hand to fit through. The resiliency in the ring allows the ring shape to return to its original configuration after the hand is passed through. Alternatively, different sized gowns may have different sized rings to accommodate hands of different people.

In the embodiment of the cuff 42 shown in FIG. 5, the ring may be formed from two concentric rings placed on each side of the terminal end 78 of the sleeve cuff, to sandwich the cuff material between the concentric rings, and ultrasonically or otherwise welded to form an integral ring. The positioning element 44 may be fastened to the cuff 42 by threads 60 or other fasteners, or may be sandwiched between the rings, as desired. Alternatively, the gown fabric on the sleeve may be inserted inside of the ring and folded backward over the entire height of the ring and sewn to itself in order to fully enclose the ring. Other configurations are available for placing the ring with the sleeve fabric to achieve the desired configuration.

The ring can be formed by injection molding to form a complete ring. Alternatively, the ring could be formed by extruding a continuous strip having the cross sections shown in the drawings. The strips may then be cut in lengths and joined to form rings.

The cuff containing the ring or other support serves several functions. It serves as an anchor for the element 44, and also maintains the sleeve cuff at least partially opened so that air or other fluid from an inflation apparatus can pass inside the sleeve. The ring also permits moisture picked up by the loop 44 or evaporated into the air inside the glove and gown to pass from the glove up the sleeve to be evacuated through the gown or otherwise evaporated. The cuff also serves as a sealing element for latex or rubber gloves to minimize the possibility of particulates escaping from inside the gown or the gloves. Since the interface between the gloves and the cuffs are areas of high potential for contamination, the cuff configuration significantly enhances the seal between the glove and the garment.

Another aspect of the present inventions provides a sleeve that can be worn separately from a body portion or gown, or in conjunction with a standard gown. A sleeve according to this aspect of the present inventions reduces the probability of contamination, and may provide more comfort to the wearer. The sleeve design may provide a better seal between a glove and the sleeve, and may also promote air circulation between the glove and the sleeve interiors, thereby improving the comfort of the wearer. A separate sleeve 90 (FIGS. 11 and 12) includes an adjustable end 92, a cuff end 94, a position element 96, and a sleeve area 98. The adjustable end 92 preferably contacts and encircles the user's arm, as illustrated by way of example in FIG. 11, so as to form a moderate seal around the arm and to hold the sleeve in place in opposition to any tendency of the sleeve to slip down the arm because of arm motion or because of any bias created by the position element 96. Including both the position element and the adjustable end produces competing tendencies in the sleeve, the position element tending to pull the sleeve down and the adjustable end tending to pull the other end up. Additionally, where a loop is used at the distal end of the sleeve, especially an elastic loop, the loop tends to bias the sleeve downward whereas the adjustable end does not have such a bias.

The end is preferably radially adjustable to accommodate different arm sizes. In this regard, the adjustable end 92 is preferably elastic so that the user may easily pull the end 92 over the user's arm, and once over the arm the elastic holds the sleeve in place over a gown 100 or other garment. Alternatively, the proximal end of the sleeve may have velcro attachment means, elastic straps to anchor the sleeve end to another garment or around the wearer's shoulder or neck or other mounting and positioning arrangement.

Figure 3:
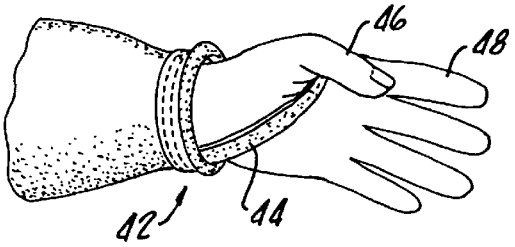
FIG. 3 is a side elevation view of a portion of the improved gown of FIG. 1 showing a sleeve portion and cuff along with a positioning element fitting between the thumb and forefinger of an operator's hand.

Preferably, the cuff 94 is positioned around or near the wrist of the user and defines the end of the sleeve 90. Preferably, the cuff 94 is rolled up to add body and strength to the end. A position element 96 has two ends that are attached, mounted or otherwise coupled to the cuff 94 to position the sleeve cuff at the desired location on the arm of the wearer. Here, the position element 94 preferably has all the characteristics, function, and benefits as the position element 44 described in FIG. 3 above, i.e. maintaining the position of the sleeve end 94 near the wrist, and wicking away moisture from the palm of the hand.

Figure 11:
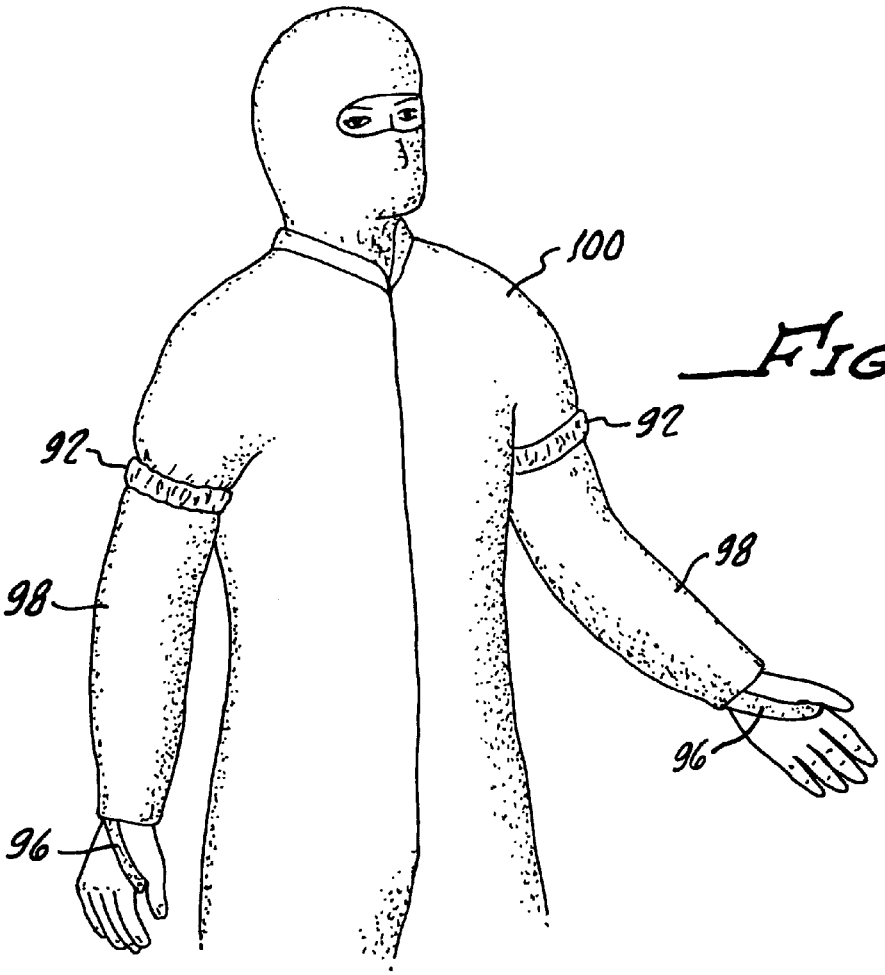
FIG. 11 is a front elevation view of a sleeve in accordance with another aspect of the present inventions being worn by an operator along with headgear.

As shown by way of example in FIG. 11, the sleeve area 98 is preferably sized to cover at least the upper portion of most users' arms while comfortably maintaining the cuff 94 near the wrist area. Additionally, the material of the sleeve 90 is preferably the same as the material used for the sleeve 40 in FIG. 1 above, i.e. non-stretchable material preferably, so that the fabric pores or openings do not change significantly in size.

According to this embodiment of the present invention, the sleeve 90 conveniently provides a method of reducing the chance of contaminating the work piece because it is the sleeve area of the gown, which is most likely to contaminate the work piece. For example, operators who exercise extra care around the wet bench area can easily put on a new sleeve before entering this area instead of having to put on a new gown and go through another air shower. Also, a full gown may not be necessary in all situations, in which case a sleeve alone without the full gown may suffice during a less sensitive or less critical operation, thus saving time and money.

Figure 12:
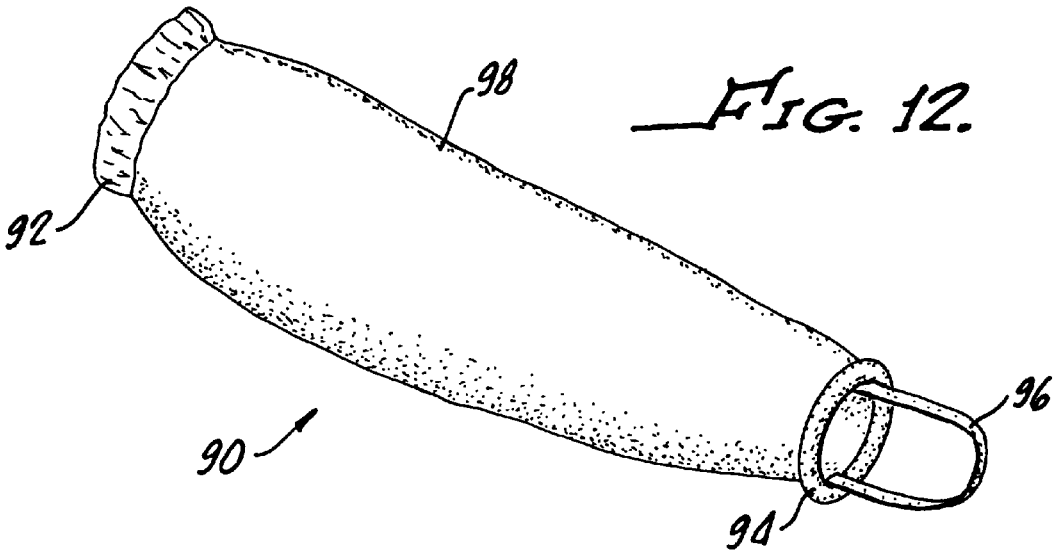
FIG. 12 is a perspective view of a sleeve in accordance with another aspect of the present inventions.
Figure 13:
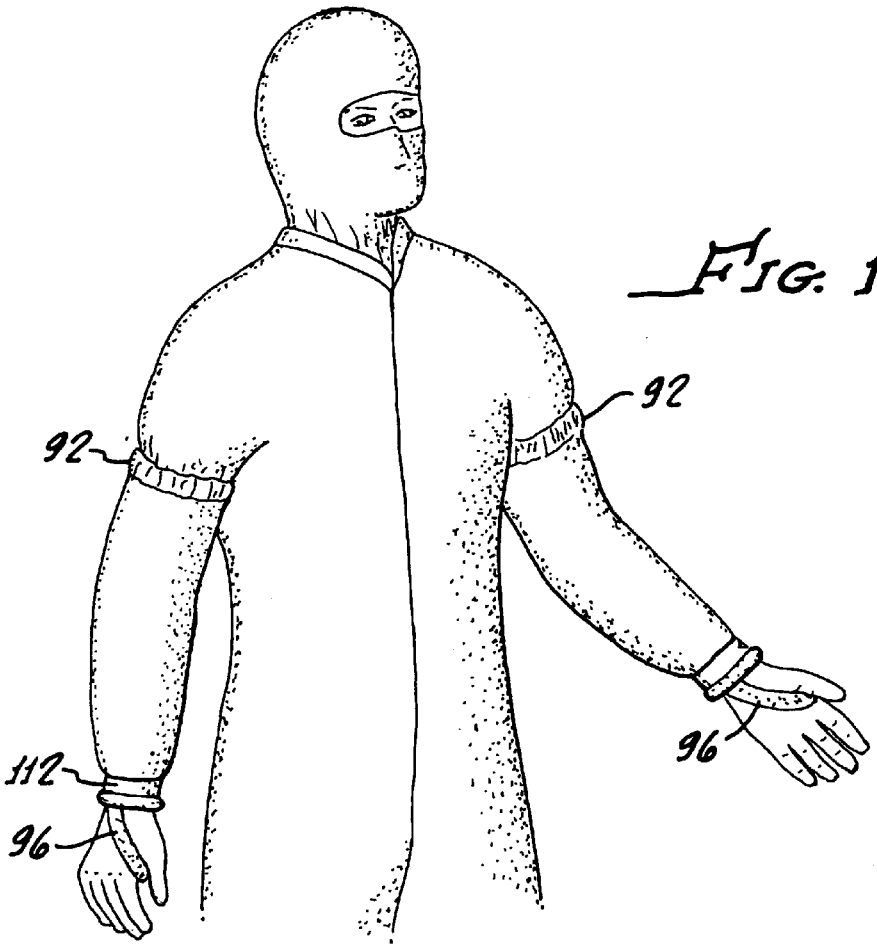
FIG. 13 is a front elevation view of a sleeve in accordance with a further aspect of the present invention being worn by an operator along with headgear.
Figure 14:
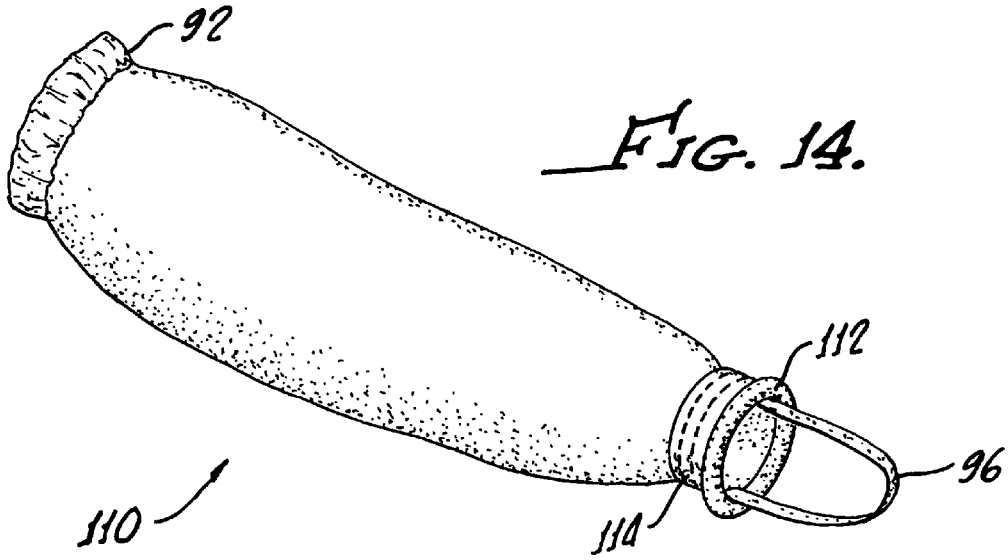
FIG. 14 is a perspective view of a sleeve in accordance with a further aspect of the present inventions.

Another alternative embodiment of the present invention is a sleeve 110, as illustrated by way of example in FIGS. 13 and 14. According to this embodiment, the sleeve 110 is similar to the sleeve 100, as shown in FIG. 12, except here, the sleeve 110 also includes a ring 114, as shown by way of example in FIG. 14. The ring 114 preferably shares the same configuration, characteristics, features, and benefits as the ring 50 described in FIGS. 5 and 8, i.e. the material is preferably resilient plastic having a circular construction with a rectangular cross section. Also, the ring 52 may be configured as in FIGS. 9 and 10, for example, to receive a glove and provide a sealing surface between the glove and the ring to minimize any loss of moisture or particulates from the glove.

One of the advantages with the sleeve cuff aspects of the present invention is that the cuff configuration can be used with the gown sleeve or with a sleeve alone. For example, when extra protection against possible contamination is needed, an operator may easily replace just the sleeve without having to change into a cleaner gown. Alternatively, in a less sensitive area but where some protection is still desired, a sleeve alone may suffice without the need of a full gown. Thus, the sleeve only without the gown offers many options to its users to quickly and easily protect against contaminating work pieces they are working on.

After donning the garment and head and foot coverings, and before gloves are placed on the hands, the operator enters the air shower 32 (FIG. 2) and inflates the gown using an inflation apparatus 80 accessible from within the air shower 32. The inflation apparatus 80 can be a stand alone unit placed within the air shower (FIG. 4) or may be installed as a permanent fixture within the air shower, such as that shown in FIG. 2. The air shower, as known to those skilled in the art, includes various air jet ports 82 for directing air streams 84 under pressure greater than ambient into the air shower 32. The air shower is under positive pressure and the air directed into the air shower is ultimately removed through appropriate ducting. The air jets 84 wash particles from the surface of the garment and away from the neck opening and the lower leg openings.

In the preferred embodiment, the inflation apparatus 80 includes a pump or blower 86 for blowing fluid such as air through appropriate conduit 88 in order to inflate the gown through the cuffs 42 and sleeves 36 (FIG. 4). Air is shown as going in the direction of the arrows 90.

The conduit 88 passes the air from the blower 86 to outlets 92 for directing the air to the gown and for accommodating the cuffs in such a manner as to provide substantially complete air flow from the conduits 88 into the interior of the sleeves. The outlet of the conduit preferably includes an adapter 94 for accepting the hand of an operator wearing a gown with the sleeve and cuff and for directing the air from the conduit over the person's hand and inside the sleeve.

In the preferred embodiment, the adapter includes an engagement element such as a funnel 96 against which the cuff 42 seats, thereby forcing the air from the outlet inside the sleeve 36. Each adapter preferably includes a proximity sensor 98 for sensing the presence, or seating, of the cuffs in the funnels 96 and activating the blower 86 to inflate the gown. In the preferred embodiment, the gown remains inflated with the blower 86 operating for as long as the proximity sensors detect the presence of both cuffs. Also in the preferred embodiment, the blower 86 does not activate until both cuffs are appropriately positioned in the funnels 96. Other sensors or means for activating the blower can be used, such as switches and the like. By the operator pushing the hands against the loops 44, the cuffs will remain seated in the funnels 96 and the gown will remain inflated until one of the cuffs is removed. The preferred flow rate for the fluid through the fabric is around one cubic foot per minute per square foot of fabric. The blower size is determined accordingly, and may be different for different gown sizes and fabric weave.

The seating of the cuff against the wall of the funnel 96 is depicted in FIG. 5.

In operation, the operator inserts the hands into the adapters 94 to activate the blower. The blower inflates the gown 20 (FIG. 2) and the air jets 84 in the air shower 32 wash away particles from the surface of the gown. The pump preferably produces approximately one cubic foot per minute per square foot of flow through the fabric, thereby ejecting any entrained or captivated particles in the fabric. The air flow into the gown also ejects particles from the neck opening and the leg openings. Since the inflation air is applied at the sleeve cuffs, any particles around the hands and wrists are pushed away from the hands and wrists and into the gown. Any air-entrained particles then pass out the neck opening or the leg openings or are retained within the gown after the pump is deactivated. Inflation of the gown causes any wrinkles and folds to be removed or eliminated, thereby improving the wash by the air jets over the gown. Inflation also stretches any porous fabrics to facilitate release of any trapped particles. This is especially the case in the wrist area, which has a higher possibility of producing contamination particles. After the pump is deactivated, relaxation of the fabric provides for a more comfortable and better fit of the gown about the operator. After the blower 86 is deactivated, the operator may place gloves over the hands so that the glove provides an airtight seal around the cuff. While it is not believed that tape is necessary, tape can be used around the cuff ring without constricting the opening of the cuff, and also without reducing wicking or migration of moisture and humid air from the hand up the sleeve.

Figure 2:
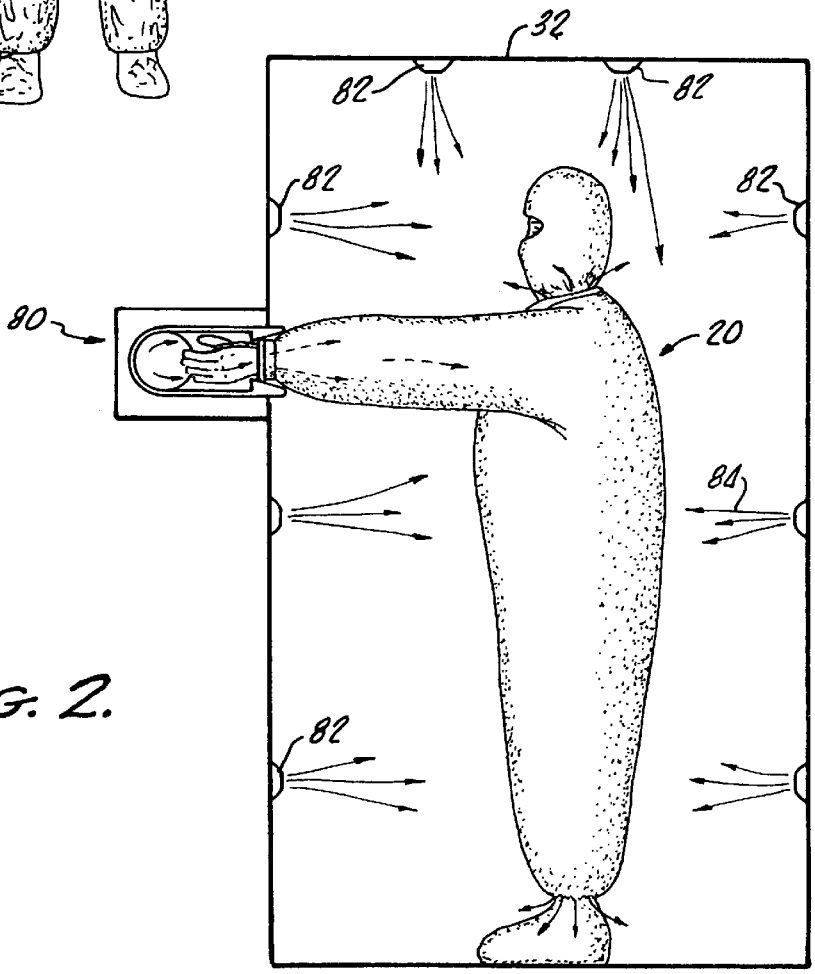
FIG. 2 is a side elevation and partial cut-away view of a contamination control room/air shower in accordance with a further aspect of the present inventions with an operator wearing a gown such as that shown in FIG. 1.

The configuration of the air shower shown in FIG. 2 has the gown inflation apparatus mounted in the wall of the air shower. In an alternative embodiment, adapters 100 can be adapted to pre-existing air jet nozzles in the air shower (FIG. 6). In a further alternative embodiment, the adapters can be placed in such a way that the operator must have the arms extended in opposite directions and along the horizontal in order to inflate the gown, thereby minimizing the possibility of any folds or creases in the gown while it is inflated. Alternatively, a gown inflation rack or assembly may permit movement of the adapters as the operator moves the hands in order to flex or move the fabric as the particles are being ejected and washed away (FIG. 7).

The foregoing description is illustrative of preferred embodiments of the invention. It is to be understood that additional embodiments thereof could be used. Therefore, the embodiments described herein, together with such additional embodiments, are within the scope of the invention. Thus, the invention is to be broadly construed, within the scope and spirit of the claims.

What is claimed is:

1. An air shower apparatus comprising:

an inflation apparatus for pumping a fluid;

a controlled enclosure to which the inflation apparatus is mechanically coupled, the controlled enclosure including two ports;

two adapters mounted around the ports, the adapters being configured to accept the hands of a person wearing a gown with sleeves and to receive and direct the fluid over the hands of the person and inside the sleeves.

2. The air shower apparatus of claim 1 wherein the adapters each include a proximity sensor for sensing a portion of the gown seated within the adapter.

3. The air shower apparatus of claim 2 wherein the proximity sensors activate the inflation apparatus when the portions of the gown are detected within the adapters.

4. The air shower apparatus of claim 3 wherein the adapters are positioned in the controlled enclosure such that the person must have his arms extended in opposite directions and along the horizontal in order to inflate the gown.

5. The air shower apparatus of claim 3 wherein the inflation apparatus operates for as long as the proximity sensors both detect the presence of the portions of the gown.

6. The air shower apparatus of claim 5 wherein the portions of the gown are cuffs and the adapters each include an engagement element into which the cuffs can seat.

7. The air shower apparatus of claim 6 wherein the engagement elements comprise funnels.

8. The air shower apparatus of claim 1 wherein the inflation apparatus produces approximately one cubic foot per minute per square foot of flot through the fabric of the gown.

9. The air shower apparatus of claim 1 wherein the adapters are movable relative to the controlled enclosure.

10. A gown inflation apparatus comprising:

a pump for pumping a fluid;

a conduit for passing the fluid from the pump to an outlet; and an adaptor on the outlet for accepting the hand of a person wearing a gown with a sleeve and directing fluid from the conduit over the person's hand and inside the sleeve.

11. The gown inflation apparatus of claim 10 further comprising:

an enclosure having walls defining sides, a ceiling and a bottom for the enclosure;

at least one closure for allowing entry into and out of the enclosure; and at least one fluid supply port for injecting fluid into the enclosure at a pressure higher than the air pressure within the enclosure.

12. An air shower apparatus comprising:

an inflation apparatus for pumping a fluid; and an adapter mechanically coupled to the inflation apparatus, the adapter being configured to accept the hand of a person wearing a gown with a sleeve and to receive and direct the fluid over the hand of the person and inside the sleeve.

13. The air shower apparatus of claim 12 further comprising:

a conduit between the inflation apparatus and the adapter for passing the fluid from the inflation apparatus to the adapter.

14. The air shower apparatus of claim 12 wherein the inflation apparatus comprises a pump or blower.

15. The air shower apparatus of claim 12 wherein the adapter includes an engagement element against which a cuff of the gown seats.

16. The air shower apparatus of claim 15 wherein the engagement element is a funnel.

17. The air shower apparatus of claim 12 wherein the adapter includes a proximity sensor for sensing a portion of the gown within the adapter.

18. The air shower apparatus of claim 17 wherein the portion of the gown is a cuff.

19. The air shower apparatus of claim 17 wherein the proximity sensor activates the inflation apparatus when the portion of the gown is detected within the adapter.

20. The air shower apparatus of claim 12 wherein the adapter includes a proximity sensor for sensing a portion of the gown seated within the adapter.

* * * * *